United States Patent [19]

Denison et al.

[11] 4,095,865

[45] Jun. 20, 1978

[54] TELEMETERING DRILL STRING WITH PIPED ELECTRICAL CONDUCTOR

[75] Inventors: Early B. Denison; Leon L. Dickson, both of Houston, Tex.; Gary L. Marsh, New Orleans, La.

[73] Assignee: Shell Oil Company, Houston, Tex.

[21] Appl. No.: 799,485

[22] Filed: May 23, 1977

[51] Int. Cl.[2] ..... H01R 3/04

[52] U.S. Cl. ..... 339/16 R; 339/117 R; 340/18 LD

[58] Field of Search ..... 339/16 R, 13, 24, 117 R; 340/18 LD

[56] References Cited

U.S. PATENT DOCUMENTS

| | | | |
|---|---|---|---|
| 2,069,359 | 10/1937 | Hawthorn | 339/16 R X |
| 2,178,931 | 11/1939 | Crites et al. | 339/16 R |
| 2,197,392 | 4/1940 | Hawthorn | 339/16 R |
| 2,531,120 | 11/1950 | Feaster | 339/16 R X |
| 3,170,137 | 2/1965 | Brandt | 339/16 R |
| 3,253,245 | 5/1966 | Brandt | 339/16 R |
| 3,696,332 | 10/1972 | Dickson, Jr. et al. | 340/18 LD |

*Primary Examiner*—Roy Lake
*Assistant Examiner*—DeWalden W. Jones

[57] ABSTRACT

An improved pipe section for use in a telemetering drill string in which each pipe section contains an insulated electrical conductor extending between insulated electrical connectors in the pipe joints. The improvement comprises encasing the conductor and insulating material in a fluid-tight metal conduit to isolate them from the fluid in or around the drill string when the pipe sections are interconnected.

10 Claims, 3 Drawing Figures

TELEMETERING DRILL STRING WITH PIPED ELECTRICAL CONDUCTOR

CROSS-REFERENCE

The present invention provides an improved insulated electrical conductor mounting arrangement for a telemetering drill string of the type described by L. L. Dickson, Jr., E. G. Ward, in U.S. Pat. No. 3,696,332.

BACKGROUND OF THE INVENTION

The present invention relates to a system for transmitting an electrical signal along a drill string or other pipe string while it is in the borehole of a well. More particularly, the invention relates to an information telemetering drill string that can be made and used without expensive specialized pipe manufacturing, or drill string operating techniques, or precautions.

The desirability of transmitting an electrical signal along a drill string was recognized over 40 years ago and numerous methods and apparatus have been proposed. Typical prior proposals have required specially-constructed drill pipe sections such as those described in U.S. Pat. No. 2,178,931, or have required complex fabrication and assembly such as continuously brazing or otherwise attaching a conduit inside the pipe joints such as those described in U.S. Pat. Nos. 2,096,359; 2,197,392; 3,170,137; or 3,253,245. The mountings shown in U.S. Pat. No. 2,531,120 for an insulated electrical conductor comprises a straight conduit, extending along the length of the pipe, and joined at each end to a passageway formed in the ends of the pipe. No mention is made of sealing the tube at its ends and no continuous or intermittent attachment of the tube to the pipe is disclosed. It can be shown that an unattached tube or conduit will preclude running wireline tools through the pipe.

In the drill string described in U.S. Pat. No. 3,696,332, the pipe joint electrical connectors comprise insulated metal rings mounted in grooves located between the inner and outer portions of mating sealing shoulders in the pipe joints. This is advantageous in isolating the connectors and associated insulating materials from fluid in or around the drill string (by the metal-to-metal joining of the pipe joint sealing shoulders) when the pipe sections are interconnected. U.S. Pat. No. 3,696,332 also discloses a conduit that extends through the pipe and joins at each end to passageways formed in the pipe. The conduit is not sealed to the pipe, nor are means for attaching the conduit to the pipe disclosed.

SUMMARY OF THE INVENTION

The present invention relates to an improved telemetering pipe string of the type in which the segments of an insulated electrical conductor are disposed in the individual sections of pipe and joined by electrical connectors in the sealing shoulders of the pipe joints. The pipe joint electrical connectors are mounted within and insulated from grooves located between inner and outer portions of the pipe joint sealing shoulders so that the connectors and insulating materials are isolated from fluid in or around the drill string by the metal-to-metal joining of the sealing shoulders when the pipe sections are interconnected. Each segment of the electrical conductor is mounted in a pipe section that contains a metal conduit that (a) extends between the pipe joint electrical connector-containing grooves, (b) contains an insulated electrical conductor segment that is electrically joined to the pipe joint electrical connectors, (c) is fluid-tight so that all portions of the insulated electrical conductor and connectors are isolated from fluid in or around the drill string when the drill pipe sections are interconnected, and (d) includes an exposed pipe-portion that is held substantially against the interior wall of the pipe string section by a means that creates low stress concentrations in the drill pipe. The invention can be used in substantially any segmented pipe string, but is particularly useful in a drill string.

The present invention also relates to a pipe string, such as a drill string, containing an isolated internal conduit which becomes fluid-tight from end to end when the pipe sections are jointed. Such an internal conduit can be used to house an insulated electrical conductor that is isolated from the components or pressures of fluids in or around the pipe string.

In the present invention it is important that the exposed pipe portion of the metal conduit mounted within each section of the pipe string be mechanically held against, or in close proximity of the inner wall of the pipe in at least one location, within about each 12 feet of distance along the pipe. This avoids substantially all interference with tool passage within the pipe. The means for holding the conduit against the wall should also avoid creating high stresses, such as those inherent in continuously brazing or cementing a conduit along most or all of the length of the pipe section. A particularly suitable conduit-attaching arrangement comprises a conduit that is formed into a curved resilient structure having a shape, such as a helix, that tends to increase in diameter by an amount such that all portions of the conduit are resiliently biased to press against the pipe wall. Such an internal conduit should have an internal diameter sufficient to contain an insulated electrical conductor and an outer diameter that is small enough to leave an adequate passageway for wireline tools (such as means for measuring inclination, temperature, pressure, or the like) between a pair of such conduits when they are pressed against opposite sides of the inner wall of the pipe section. In a preferred arragnement, the ratio of the circuit diameter to the pipe inner diameter is not more than about 0.2 and preferably is about 0.1.

In typically encountered conditions of drilling boreholes and/or installing pipe strings within boreholes of wells, the pipe strings may bend by amounts that may move an internal conduit toward the center of the pipe in a manner that would interfere with the passage of a tool within the pipe. For example, if a 30-foot length of drill pipe is flexed at a constant curvature over its length (where the pipe has an inner diameter of about $3\frac{7}{8}$ inches and contains an internal conduit that is attached at its ends and has an outer diameter of about $\frac{3}{8}$ inches); if the pipe curvature reaches 4.46° per 30-feet (15° per 100 feet), the conduit, even though it is kept in a straight line, will extend across the pipe interior and touch the opposite wall of the pipe. Curvatures approaching this magnitude are common, especially in offshore wells where a large number are driled from a single platform. In addition, it is obvious that a much smaller amount of curvature could move such a conduit away from the adjacent wall by an amount making it likely to entangle a wireline run through the pipe. Such an intereference with tool passageway can be substantially avoided by ensuring that the conduit is held against the pipe wall in at least one location within about each 12 feet of distance along the pipe.

In addition, drill strings are often operated in a near-horizontal position (i.e., up to 70° or more from the vertical), which will cause an unsupported internal conduit to droop across the pipe bore where it can easily cause a wireline to become entangled.

The present invention also relates to a method for mounting an insulated electrical conductor and conductor-containing conduit to complete the circuit between insulated electrical connectors that are mounted in the sealing shoulders of the tool joints. A metal conduit containing an exposed portion that extends through the drill spring pipe section between the tool joints. The metal conduit is made fluid-tight, and the exposed pipe portion is mounted within the drill string pipe section so that it is held substantially against the inner wall of the pipe by a means that creates low stress concentrations in the pipe. The circuit is completed by an electrical conductor that extends through the conduit and passageways formed in the tool joints and is connected to the contact rings.

DESCRIPTION OF THE INVENTION

Figure 1:
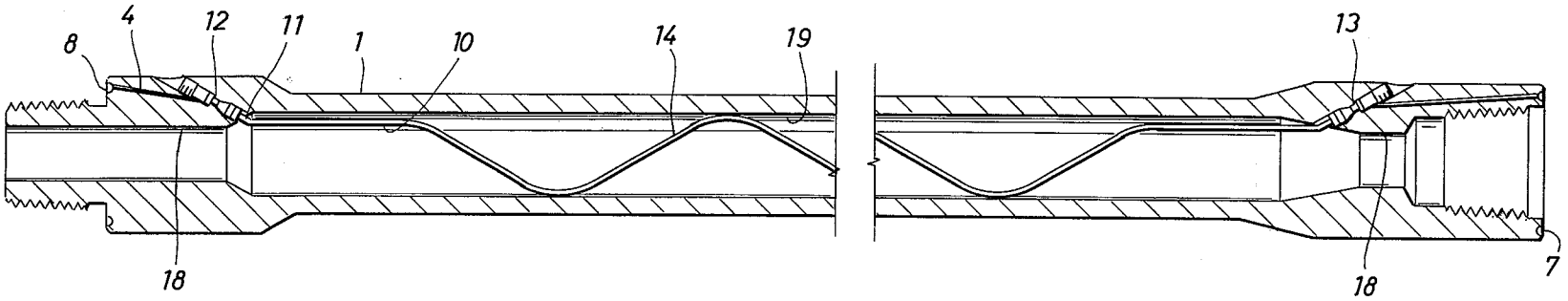
FIG. 1 shows a pipe section of a preferred embodiment of the present invention.

The nature and disposition of the electrical conductor-containing fluid-tight conduit within the drill pipe sections is an important feature of the present invention. In prior designs, it was envisioned that running an insulated conductor along the pipe between tool joints would be relatively simple and straightforward. However, due to the numerous constraints, that problem is rather complex. For example:

1. The drill pipe elongation is very significant, even for normal tension loads, and any attachment to the pipe must stretch with it.
2. Metal cannot be removed from the drill pipe itself due to the resulting stress concentrations and reduced strength.
3. The metallurgy of the pipe and tool joints cannot be degraded by excessive heatings, weldings, et cetera, because the reduced strength and/or abrasion resistance would be intolerable.
4. The conductor must be positioned inside the pipe due to the mechanical abuse to which the exterior is subjected.
5. The conductor must not interfere with wire line tools which might be run in a typical drilling operation. It cannot be loosely hung inside of the pipe or a tool could become entwined and/or hung up—especially in a directional hole in a severe dogleg or abrupt change in borehole direction.
6. The conductor and associated fixtures/supports must withstand the abrasion of the drilling fluid, the bottom hole pressure and temperature, the impact of passing wire line tools, et cetera.
7. Fluid leaks into the electrical connector grooves via the conductor passage must be avoided.
8. Any additions to the drill pipe must not enhance its susceptibility to corrosion.
9. Any increase in pressure losses in the circulating mud stream must be minimized.

A possible telemetering system could comprise the use of armored cables, which are extremely strong, flexible, and readily available, and have their conductors isolated from fluids. However, their terminations are relatively large and would need to be in the bore of the tool joint unless the joint itself were modified. The sealing of such terminations is not simple and permanent, and the cable would require several support points along the pipe length. Furthermore, the insulating material used in the armored cable would be exposed to the well bore fluid.

Magnesium oxide insulated conductors with stainless steel sheaths are available and capable of withstanding high temperatures and pressures encountered in drilling deep wells. However, they are: difficult to terminate; easily damaged by absorbed moisture, which renders the insulation conductive; and their conductor-sheath capacitance is extremely high, which would be detrimental to the transmission of high-frequency signals.

In the present invention, the fluid-tight electrical conductor-containing metal conduit contains exposed portions which join at each end with passageways formed in the tool joints of the pipe. The seal between the conduit and the tool joint is made fluid-tight and the conduit is supported in the pipe by forming the conduit in a helix which presses against the wall of the pipe.

In the present invention, it is important that the insulated electrical conductor be run inside a protective tube or conduit from tool joint groove to tool joint groove to protect it from the circulating mud stream. The conduit should not restrict tool passage in the pipe, it should elongate with the pipe; it should be mechanically strong and pressure tight; and its presence should not weaken the pipe body. In view of such constraints, and where the conduit has an exposed section within the drill pipe, periodic attachment points along the drill pipe are generally preferred over a continuous attachment. In prior art arrangements, attempts have been made to attach the conduit to the drill pipe by welding or the like. This, of course, introduces stress concentrations in addition to being difficult to fabricate.

An alternative to the above technique for supporting the exposed portion of the conduit and maintaining it, at least substantially, against the wall of the drill pipe, is to simply form that portion of the conduit in a resilient structure, such as a helix wound with a left-hand spiral, that is biased to move toward the pipe wall and attach only the ends of the conduit to the tool joints. A conduit installed in this manner will remain out of the pipe bore and will also meet all of the other design constraints.

The helix should preferably be wound with a left-hand or counterclockwise spiral to minimize pressure loss within the pipe bore and mechanical loading on the conduit anchor points. This assumes a right-hand or clockwise rotating drill string.

FIG. 1 shows a particularly suitable way of mounting conduit 14 within pipe section 1. Substantially straight sections 10 near the ends of the conduit terminate in end portions 11 that are inserted in passageways 12 and 13 formed in the pin and box ends of the tool joint, respectively. The midportion of the conduit, portion 14, is curved into a substantially helical shape that is resiliently biased to expand to a diameter at least substantially equalling the inner diameter of pipe. Thus, after the conduit structure is resiliently deformed and emplaced within the pipe, substantially all portions of the conduit are resiliently pressed against the pipe wall. In such an embodiment (for thirty-foot pipe sections), the stright sections near the ends of the conduit 15 preferably have lengths of about 1 to 2 feet, with the distance between the turns or "the lead" of the helical arrangement being from about 3 to 5 feet, with 4 feet/turn being especially suitable.

The tool joints and drill pipe, shown in FIG. 1, are especially designed to simplify fabrication of the system and its use. The tool joints are known as X-hole tool joints, but have a reduced internal diameter. For example, in a 4½ inch diameter drill string, 4½ inch X-hole tool joints having a minimum internal diameter 18 of 2½ inch where used. These tool joints were used with 4½ inch, 20 pound/foot grade E external upset drill pipe. The use of external upset drill pipe is important since it provides a constant uniform internal diameter 19 that allows helical conduit 14 to uniformly contact the wall. In addition, the stright ends 10 of the conduit will not require any special bends to conform to the inner diameter of the pipe as would be required with internal upset drill pipe. The small internal diameter of the tool joints insures that any wireline tool that passes through the tool joint will pass through the drill pipe, since the inner diameter of the helix is larger. The above drill pipe has an internal diameter of 3.64 inches, while the conduit 14 has an outside diameter of 0.375 inches; thus, the internal diameter of the helix will be approximately 2.89 inches, while the minimum diameter 18 is 2½ inches. In addition, the entrance angle 16 of the pin joint and the exit angle 17 of the box joint are designed to minimize the pressure drop across the joint. An entrance angle of 30° per side and an exit angle of 10° per side have produced excellent results. An entrance angle of 20° per side and an exit angle of 6° per side produce minimal pressure drop but their fabrication is somewhat more complex.

Figure 3:
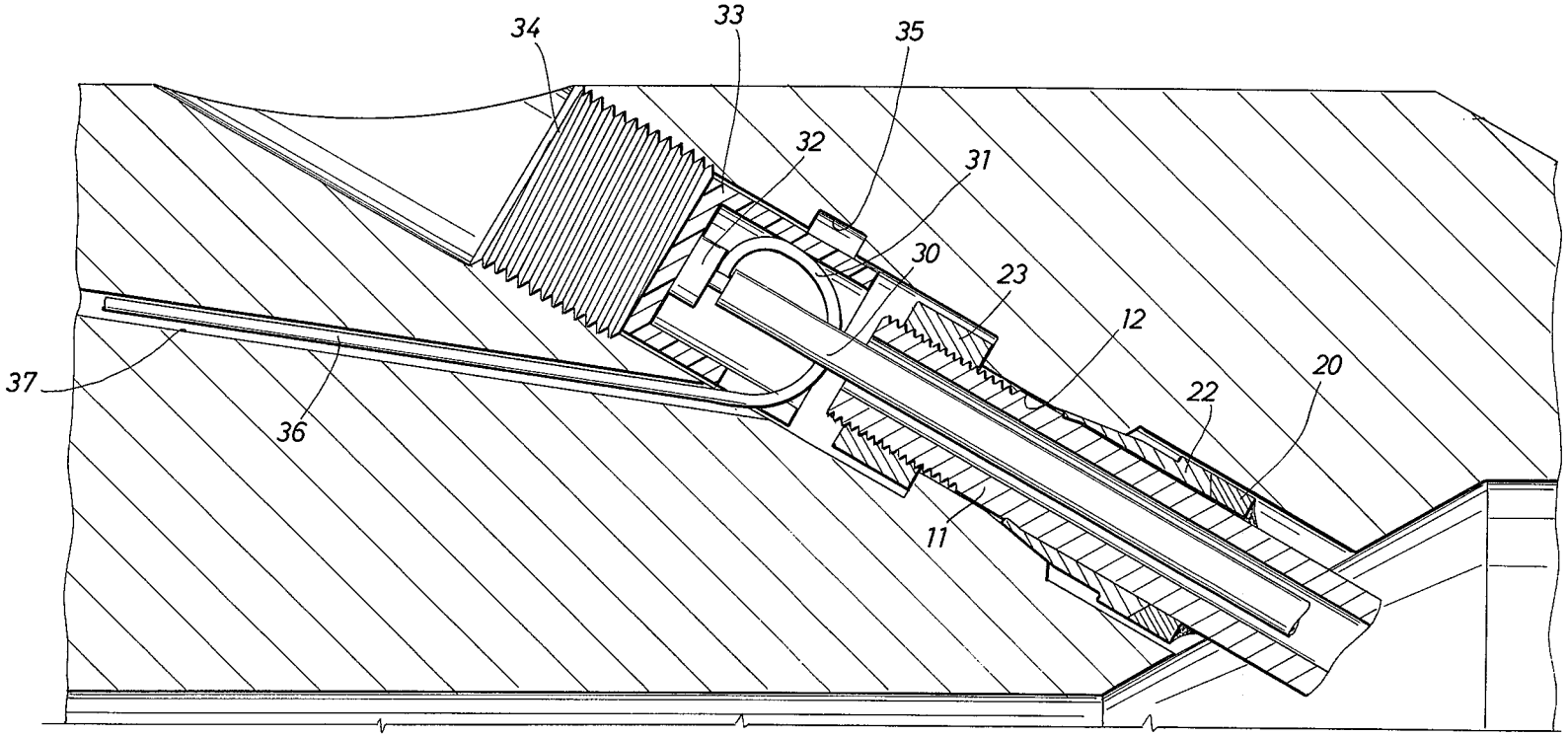
FIG. 3 is an enlarged view of the wire junctions in the tool joint.
Figure 2:
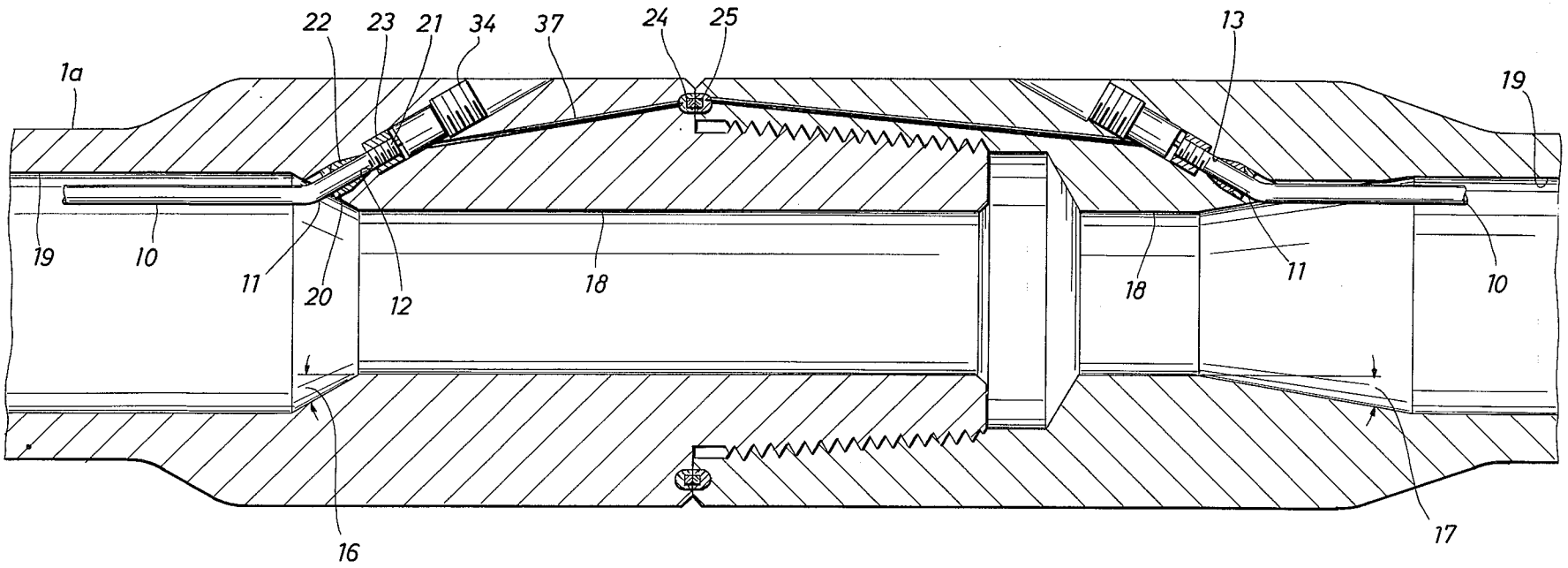
FIG. 2 shows an enlarged view of the tool joint of the embodiment of FIG. 1.

FIG. 3 shows a preferred arrangement of the passageways 12 and 13, and the attachment of the conduit ends to the passageways. In particular, the ends of the conduit in the tool joint are provided with a small flange member 20, which may be a separate ring fastened to the end of the conduit by suitable means, such as welding or silver soldering. The end 21 of the conduit is threaded so that a sealing ring 22 will be drawn into a sealing engagement with a shoulder formed in the passageway, by tightening the nut 23 on the threaded end of the conduit, to draw the end of the conduit into the passageway 12. Various types of sealing arrangements can be used, although excellent results have been obtained by utilizing a commercial form of metal-to-metal compression seal, and forming the surface of the flange 20 to the shape of its companion seal member. For example, suitable compression seals are those sold commercially under the trade name of Swagelok. After both ends of the tube are securely locked in place by the above-described arrangement, the electrical wire may be led through the conduit and attached to the contact rings 24 and 25, as shown in FIG. 2.

The insulated electrical conductors used in the present invention can be substantially any commercially available electrical conductors. Those having a relatively low electrical capacitance between the wire and the outer conduit, and high resistance between the wire and conduit (ground), are preferred. The size of the insulated electrical conductor is preferably correlated with that of the conductor-containing conduit so that the electrical conductor will slide relatively easily within the conduit (for installation purposes), and with the current capacity and voltage drop requirements of the conductor.

As shown in FIG. 3, the electrical wire 30 that extends through the end 11 of the conduit is coupled to a pigtail element 36, which is attached to the contact ring in the tool joint. Two wires are coupled together by suitable crimp connector 32, with an insulating cap 33 being placed over the connection. This pigtail 36 is threaded through a passageway 37 that leads from the contact ring to the passageway 12. The end of the passageway, formed in the tool joint, is closed by means of a threaded sealing plug 34. A small radial recess 35 is formed in the passageway of the tool joint, and serves as a location for the pigtail 36 when it is necessary to remove the conduit from a pipe section to replace the conduit due to wear or similar problems. In this case, the connection between the pigtail and the electrical conductor can be broken, and the pigtail placed in the radial recess to permit the nut 23 to be removed from the end of the tube without disturbing the end of the pigtail. This greatly simplifies the replacement of the conduit since it does not require the removal of the contact rings from the tool joint. While the contact rings may be removed, it is a difficult process since they are cemented in place, and thus, would entail a long reinstallation process that requires complete cleaning of the groove in the tool joint before the insulating ring, and contact ring can be recemented in place. Normally, epoxy cements are used, which are difficult to remove without remachining the groove. Since the wear is confined to the helical portion of the conduit, only the conduit must be renewed and this is a relatively simple operation. Thus, the pipe sections can be reused and will have the same life as a normal drill string.

We claim as our invention:

1. An improved pipe section for use in a rotary drill string, said drill string including an electrical conductor extending through each pipe section, said pipe section comprising:

a section of uniform diameter drill pipe, said drill pipe having external upset ends;

a pin tool joint, said pin tool joint having a smaller internal diameter than said drill pipe, and in addition, being joined to one end of said drill pipe;

a box tool joint, said box tool joint having a smaller internal diameter than the drill pipe, and in addition, being joined to the other end of said drill pipe;

a conduit, said conduit having a helical form with straight end portions, the outer diameter of said helix being sized to firmly engage the inner wall of the drill pipe when said conduit is placed in the drill pipe;

a passageway formed in both said box and pin tool joints, the ends of said conduit being formed to align with said passageways;

sealing means, one of said sealing means being disposed in each of said passageways to both form a fluid-tight seal between said conduit and said passageway, and in addition, mechanically anchor said conduit in said passageways; and an insulated electrical contact ring disposed in the sealing shoulders of both said box and pin joints, said passageways communicating with said contact rings whereby an electrical conductor may be attached to the contact rings in one of said joints, and extend through said passageways and conduit, and be attached to the contact in the other of said joints.

2. The improved pipe section of claim 1 wherein the internal diameter of the box and pin tool joints is less than the inner diameter of the helix.

3. The improved pipe section of claim 2 wherein both said box and pin joints include a transition section for joining their internal diameter to the internal diameter of the drill pipe, said transition section in said pin joint having a 30° per side transition angle and a 10° per side transition angle in said box joint.

4. The improved pipe section of claim 3 wherein said passageways in said box and pin joints intersect the interior of said joints in the transition section of said joints.

5. The improved pipe section of claim 4 wherein said sealing means comprises a flange member attached to each end of the conduit, a compressable sealing ring, and a nut that threads over the end of the conduit and coacts with a shoulder formed on said passageways to compress said sealing ring between said shoulder and said flange, thereby forming a fluid-tight seal between said conduits and said passageway.

6. The improved pipe section of claim 1 wherein said insulated electrical conductor comprises a short wire pigtail attached to each contact ring, and a continuous conductor extending through said conduit, the ends of the pigtails being joined to the ends of the continuous conductor.

7. The improved pipe section of claim 6, and in addition, a recess formed in the passageway in both said box and pin ends for storing said pigtails when said conduit is being installed in the pipe section.

8. The improved pipe section of claim 1, and in addition, each of said sealing means comprising a shoulder formed in said passageway and a ring disposed on the ends of said conduit, a seal disposed between the shoulder and the ring, and means for drawing the conduit into the passageway to compress the seal and form a metal-to-metal seal between the passageway and the conduit.

9. A method for anchoring a conduit in a section of pipe used for rotary drilling wherein said conduit forms part of a fluid-tight passageway for an electrical conductor, said method comprising:

forming said conduit in a helical form having straight end portions;

forming passageways in the end portions of said pipe section;

forming the end portions of the conduit to conform to the passageways in the end portions of the pipe section; and anchoring the ends of the conduit in the passageways in said pipe section.

10. An improved pipe section for use in rotary drilling, said pipe section having a fluid-tight passageway extending between sealing shoulders of said pipe section, said fluid-tight passageway comprising:

a passageway formed in the tool joint at each end of the pipe section, said passageway extending from the sealing shoulder to the interior of the pipe section;

a conduit, said conduit being formed in a helical shape with the outer diameter of the helix being chosen to insure substantial contact between the outer diameter of the helix, and the inner surface of the pipe section when said conduit is disposed in the interior of the pipe section with the ends of said conduit extending into said passageways; and sealing and anchoring means attached to the ends of the conduit to both seal and anchor the ends of the conduit in said passageways.

* * * * *